United States Patent [19]

Lo

[11] 4,363,227

[45] Dec. 14, 1982

[54] DOOR LOCK CONSTRUCTION

[76] Inventor: Jiung-P'eng Lo, No. 12, La. 1020, Chen Teh Rd., Taipei, Taiwan

[21] Appl. No.: 149,665

[22] Filed: May 14, 1980

[51] Int. Cl.[3] ..... E05B 55/00

[52] U.S. Cl. ..... 70/144; 70/151 R; 70/472; 70/DIG. 6; 292/169.14; 292/333

[58] Field of Search ..... 70/144, 150, 151 R, 70/151 A, 472, DIG. 6, 108–111, 129; 292/169.14, 165, 167, 332, 333, 158, 159

[56] References Cited

U.S. PATENT DOCUMENTS

| | | | |
|---|---|---|---|
| 491,285 | 2/1893 | Herrmann | 292/159 |
| 861,420 | 7/1907 | Young | 292/167 |
| 1,299,195 | 4/1919 | Kohn | 292/333 X |
| 2,613,094 | 10/1952 | Schlage | 292/167 X |
| 3,912,309 | 10/1975 | Fischer et al. | 292/167 |

FOREIGN PATENT DOCUMENTS

| | | | |
|---|---|---|---|
| 141684 | 5/1935 | Austria | 292/333 |
| 2431590 | 3/1980 | France | 292/333 |
| 376968 | 7/1932 | United Kingdom | 292/333 |

*Primary Examiner*—William E. Lyddane
*Attorney, Agent, or Firm*—Shoemaker and Mattare, Ltd.

[57] ABSTRACT

An improved door lock construction comprising a lock bolt formed in U-shape operable in association with an actuating mechanism, an interlocking device, a dog device and a hold-release device assembled in a box type housing to be mounted on the inner side of the door, capable of locking the door on closing and further locking with a key.

16 Claims, 21 Drawing Figures

20
21
21M
21E
210
211
212
213
214
215
212A
221
221A
222
223
224
224A
225
226
227
228
22
22A
261
262
263
264
265
266
267
26
251
252
253
25
24
241
242
141
142
143
111
112
113
114
115
116
121
40
12
14
15
16
17
18
11
30
238
239
234
233
232
235
236
237
231
230
23
200
213A
214A
215A
227A

DOOR LOCK CONSTRUCTION

BACKGROUND OF THE INVENTION

Various types of door locks are commercially available, of which the most commonly used two types are a spring-loaded, latch bolt type and a toggle-operated dead bolt type. The locks of latch bolt type mainly comprise a spring-loaded lock bolt having a tapered head, and are commonly used for latching the door on closing. The locks of dead bolt type are operable only with a key or an operating handle provided therewith. The locks of latch bolt type provide the convenience of latching the door automatically on closing, but they provide less security as their tapered, spring loaded latch can be pushed back with a thin tool. The locks of dead bolt type provide better security as their bolt can not be retracted without a key or the operating handle readily provided with the locks, but they lack the convenience of latching or locking the door on closing. Therefore, it has become a common and costly practice to install both types of locks on a door in most houses and buildings.

In view of the above mentioned shortcomings of conventional door locks, the present invention proposes a novel door lock construction which eliminates these shortcomings.

SUMMARY OF THE INVENTION

This invention relates to door locks, more particularly to improvements in the construction of door locks of mortise type, the improved construction being characterized in having a lock bolt formed in U shape and operable in association with an actuating mechanism, a plurality of compression springs adapted for urging the lock bolt forward, an interlocking device, a dog device and a hold-release device assembled in a box type housing to be mounted on the inner side of the door; the dog device, which is adapted to keep the lockbolt in fully retracted position, is arranged to be hit, or triggered, by the jamb on which the strike is mounted to cooperate with the lock when the door is closed, to relieve the lockbolt, thus enabling the lockbolt to slide forward by the force of a spring provided for that purpose, to engage with the strike on the jamb; the actuating mechanism is operable with the tail piece of a lock cylinder to be used in association with this invention to move the lock bolt forward and backward, and is also adapted to operate the interlocking device, which "interlocks" the lockbolt in locking positions, in cooperation with the movement of the actuating mechanism; the hold-release device is adapted to hold or release the lockbolt on or from the fully retracted position and is operable selectively manually.

The lock construction of this invention is provided with two interlocking positions: one corresponding to the first locking position where the lockbolt is half-way extended to lock the door on closing; the other corresponding to the second locking position where the lockbolt is fully extended or in the fore-most position.

It is an object of this invention to provide an improved door lock construction capable of automatically locking the door on closing.

It is another object of this invention to provide an improved door lock construction capable of further locking manually after first locking on closing the door, and at the second locking position the lock can not be unlocked with the operating handle but one has to use a key.

It is still another object of this invention to provide an improved door lock construction with extra strength.

DETAILED DESCRIPTION OF THE INVENTION

The objects, features and arrangement of the improved door lock construction will be more fully understood from the following detailed description taken in conjunction with the accompanying drawings, in which:

FIG. 3 is an oblique, exploded view of the door lock assembly of this invention, showing the arrangement of each component.

DETAILED DESCRIPTION

Figures 1, 2:
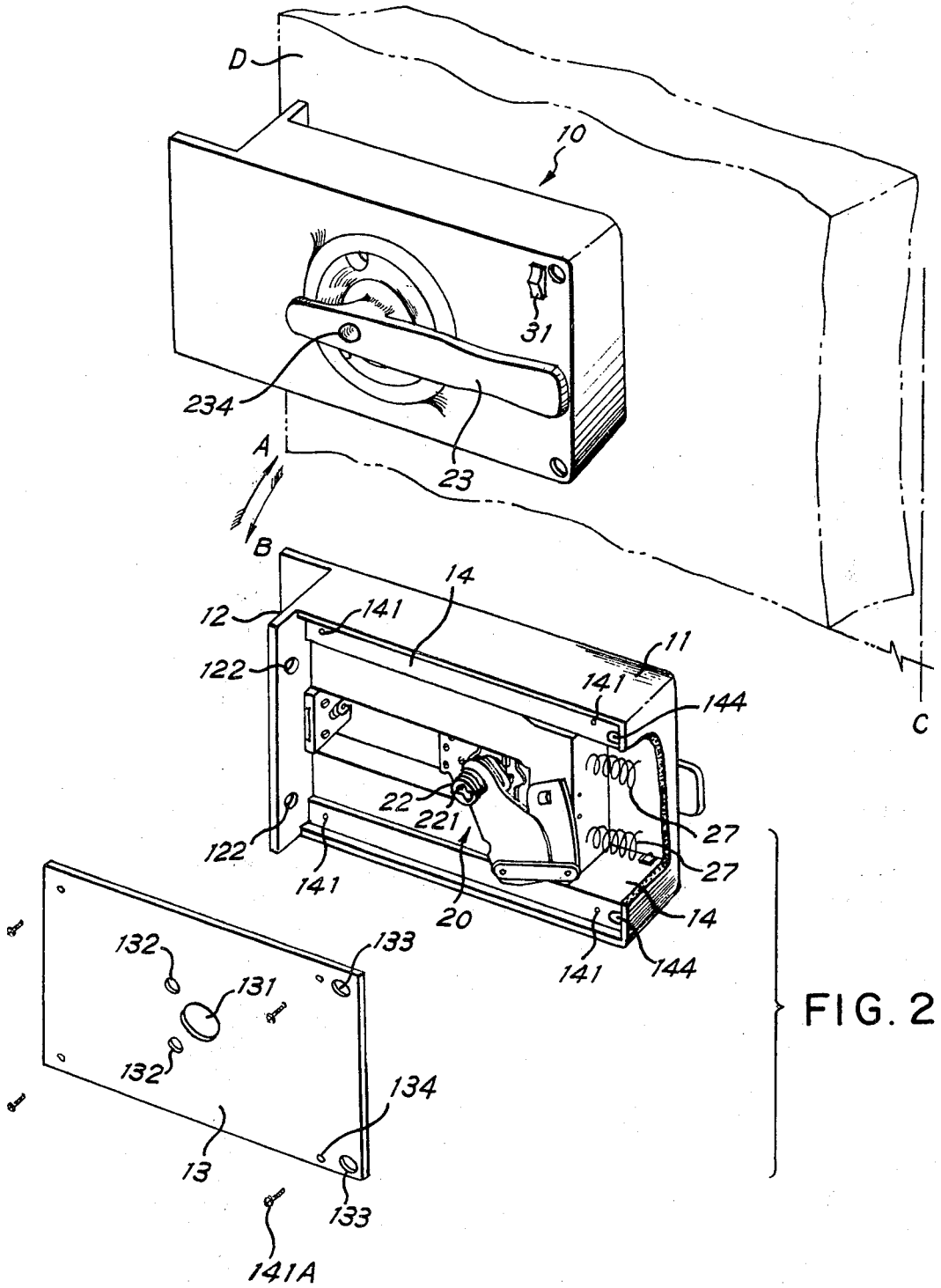
FIG. 1 is an oblique, perspective view of the door lock assembly of this invention, viewed from the inside of the door.
FIG. 2 is an oblique perspective view of the door lock assembly of this invention, viewed from the outside of the door, with the lock assembly dismantled from the door and with the cover plate removed.

Referring now to FIGS. 1 through 6, the door lock of this invention generally designated by 10 comprises a housing 11, a cover plate 13, an actuating mechanism 20, a U-shaped lock bolt 21, an inter-locking device 200, a dog device 40, a Hold-Release device 30, an operating handle assembly 230 and a plurality of compression springs 27.

The lock-cylinder operable with a matching Key is a separate unit to be mounted on the lock assembly, with the tail piece of the lock-cylinder inserted in the hole 221 of the drive shaft 22 which will be described in detail hereafter; it is to be understood that in the following description the operation of the drive shaft 22 is performed with a key through the lock-cylinder although the lock-cylinder may not always be mentioned.

The lock-cylinder is also not shown in the drawing as it is not intended to be a part of this invention.

The housing 11 is of a rectangular, box-like construction having a front panel 12, upper and lower side panels 15 each having an inside wall member 14 of a height lower than the side panel, a rear panel 16 of the same height as the side panels, and a bottom panel 17. The front panel 12 has a portion extended above the side panels, a plurality of mounting holes 122 are provided on that extended portion for mounting the housing 11 to the door with cap screws. The bottom panel 17 has an extended portion 18 beyond the front panel 12. The inside wall members 14 are each provided with threaded holes 141 for mounting the cover plate 13 with cap screws 141A, and through holes 144 in which mounting screws, not shown, may be put to mount the housing on the door. Two blind holes 143 and 142 are provided in each of said inside wall members 14 as shown in FIG. 3, to receive the head portion 213 of the iner-lock members 215 to be described later.

The front panel 12 is provided with two rectangular openings 121 through which the end portions of the lock bolt are slidably extendable. In the middle portion of the junction between front panel 12 and the bottom panel 17 another opening 123 (FIG. 9B) is formed to receive the trigger piece 48 of the dog device 40.

A plate 116 having two hollow, cylindrical posts 113 for supporting the cover plate 13 is fixed in a suitable place onto the inner surface of the bottom panel 17 by proper means such as spot welding, said plate 116 being of proper thickness to provide adequate clearance between the bottom surface of the lock bolt 21 and the inner surface of the bottom panel 17, so that the washer 24 and the trigger piece 48 which will be described later, are allowed to move therein properly. The plate 116 is further provided with both a plurality of threaded holes 115 for mounting the lower cam plate 25, and a curved cut-out 114. The bottom panel 17 is provided with two holes 113A (FIG. 12) corresponding with the through holes in the posts 113, so that mounting screws, not shown, may be put there through.

The bottom panel 17 is formed with a hole 111 in approximately the center position, through which the hollow, cylindrical spindle 232 of the operating handle assembly may be inserted. An arcuate slot 112 is formed around the hole 111 for receiving the stopper 237 provided on the inner surface of the disc 231 of the operating handle assembly 230.

The lock bolt 21 as shown in FIG. 3 is formed in a U shape, having a pair of slender bolt members 21M of rectangular cross section and a cross beam 21E which is also of rectangular cross section. A through hole 211 is provided in the middle portion of the cross beam 21E with the axis of the hole perpendicular to the plane of the lock bolt 21, and another through hole 212 is provided in the cross beam 21E along the axis thereof, to cross with the through hole 211. The through hole 211 is adapted to accommodate the cam shaft 227 of the actuating mechanism 20, and the through hole 212 is adapted to accommodate the inter-locking device 200 to be described later. A notch 21C is formed on the bottom inner side of the end portion of each bolt member 21M to be engaged with and disengaged from the dog plate 471 (FIG. 9A) of the dog device 40. The cross beam 21E is formed with a step portion 21A on the bottom side (FIG. 10A) and a recess 21B provided in the middle portion thereof, and also a notch 21D on one end edge of the bottom side. The step portion 21A is of a height corresponding to the thickness of the plate 116, and the recess 21B is capable of receiving the nose portion 241 of the washer 24. The notch 21D is adapted to be engaged with and disengaged from the stopper piece 32 of the hold-release device 30.

The actuating mechanism 20 comprises a cam shaft 227, a crank 226, a connecting link 225, a drive arm 224, and a drive shaft 22. The lower end of the cam shaft 227 has two protruding cams 227A each having ellipse-shaped cross sections integrally formed therewith and symetrically disposed to form two opposing cavities 228 in between the cams 227A, in such a manner that the axis connecting the two ellipses 227A crosses perpendicularly with the axis connecting the two cavities 228. The upper end of the cam shaft 227 is fixed to one end of the crank 226. The other end of the crank 226 is pivotally connected to the end of the connecting link 225 whose other end is pivotally connected to one end of the drive arm 224, and the other end of the drive arm is fixed to the drive shaft 22. The drive shaft 22 comprises an upper extension 22A having a slot 221 in which the tail piece of a lock cylinder may be inserted, a square shank 222 on which an upper cam plate 26 is slidably mounted, and a lower extension 223 which is slidably inserted in the through hole 234 of the spindle 232 of the operating handle assembly 230. At the end of the lower extension 223 a slot 221A is formed to receive a key means which may be inserted in the through hole 234 from the outside of the operating handle assembly 230.

The drive arm 224 is provided with an arcuate nose portion 224A capable of abutting with the crank 226 side to side when the lock bolt 21 is in such positions that the crank 226 is adjacent to the drive arm 224. The arcuate nose portion 224A acts as a cam capable of pushing the crank 226 with the cam shaft 227 to move away from the drive shaft 22 when the drive shaft 22 is rotated counter-clockwise.

The actuating mechanism 20 also comprises a helical, compression spring 267 disposed over the square shank 222 under the drive arm 224, an upper cam plate 26 having a square hole 261 slidably mounted on the square shank 222 of the drive shaft 22 under the spring 267, and a lower cam plate 25. The lower face of the upper cam plate 26 is provided with a pair of projections 263 disposed on two opposing sides of the square hole, having key portions 264 capable of engaging with and disengaging from the slot 233 formed at the top end of the spindle 232 of the operating handle assembly 230, each of said projections 263 having a helically inclined surface 266 at one side and a vertical edge 265 on the other side, symetrically arranged in such a manner that when the cam plate 26 is rotated with the drive shaft clockwise, the helically inclined surfaces 266 are on the leading side of the projections 263. The lower cam plate 25, which has been previously introduced as to be fixedly mounted on the plate 116, has a U-shaped opening 251 and a pair of projections 252 on its upper side, said projections having the same helically inclined surfaces 252 as the upper cam plate 25 to cooperate therewith. The lower cam plate 25 is also formed with a recess flush with the lower point of said helically inclined surface, to accommodate one of the two projections 263 of the upper cam plate when the two cam plates are assembled with the projection sides facing each other, in such a manner that when the upper and lower cam plates are engaged with each other with the projections 263 of the upper cam plate 26 disposed in the U-shaped opening 251 and the recess in the lower cam plate 25 respectively, the upper cam plate 26 is in the lowest position; the upper cam plate 26 will be raised if rotated 90 degrees clockwise with respect to the lower cam plate 25.

The operating handle assembly 230 comprises a hollow spindle 232 having a slot 233 on its top end to be engaged with and disengaged from the key portions 264 of the upper cam plate 26, a flange portion 231 formed coaxically with the spindle 232, an annular groove 235 formed on the flange portion 231 around the spindle 232, a stopper piece 237, and a handle 23, formed integrally in one piece. Two cut outs 239 are formed on the circumference of the flange portion 231, which will be explained later. A pair of stopper means 236 having a gap between each other to allow the entry of the projection 117 in the recess 118 of the bottom side of the housing 11 is provided in the annular groove 235. A helical, compression spring 238 is placed in the groove 235 with the two ends stopped by said stopper means 236. The operating handle assembly is attached to the housing 11 from the bottom side with the spindle 232 passing through the hole 111 in the bottom panel 17 of the housing 11, with the stopper piece 237 fitting in the arcuate slot 112 and the projection 117 disposed in between the pair of stopper means 236. The washer 24 is mounted over the spindle 232 (before mounting the lower cam plate 25 on to the plate 116) and fixed to the spindle by proper means such as welding. When the operating handle assembly is rotated, one end of the spring 238 is depressed by the stopper means 236 and the other end is held by the projection 117 therefore a reactive spring force is generated against the rotation of the operating handle assembly, which forces the operating handle assembly 230 to return to its original position, i.e., neutral position, when the operating handle assembly is relieved from the rotational force.

The engagement of the stopper piece 237 with the arcuate slot 112 defines the range of the rotation of the operating handle assembly 230.

Figures 3A, 4, 5, 6:
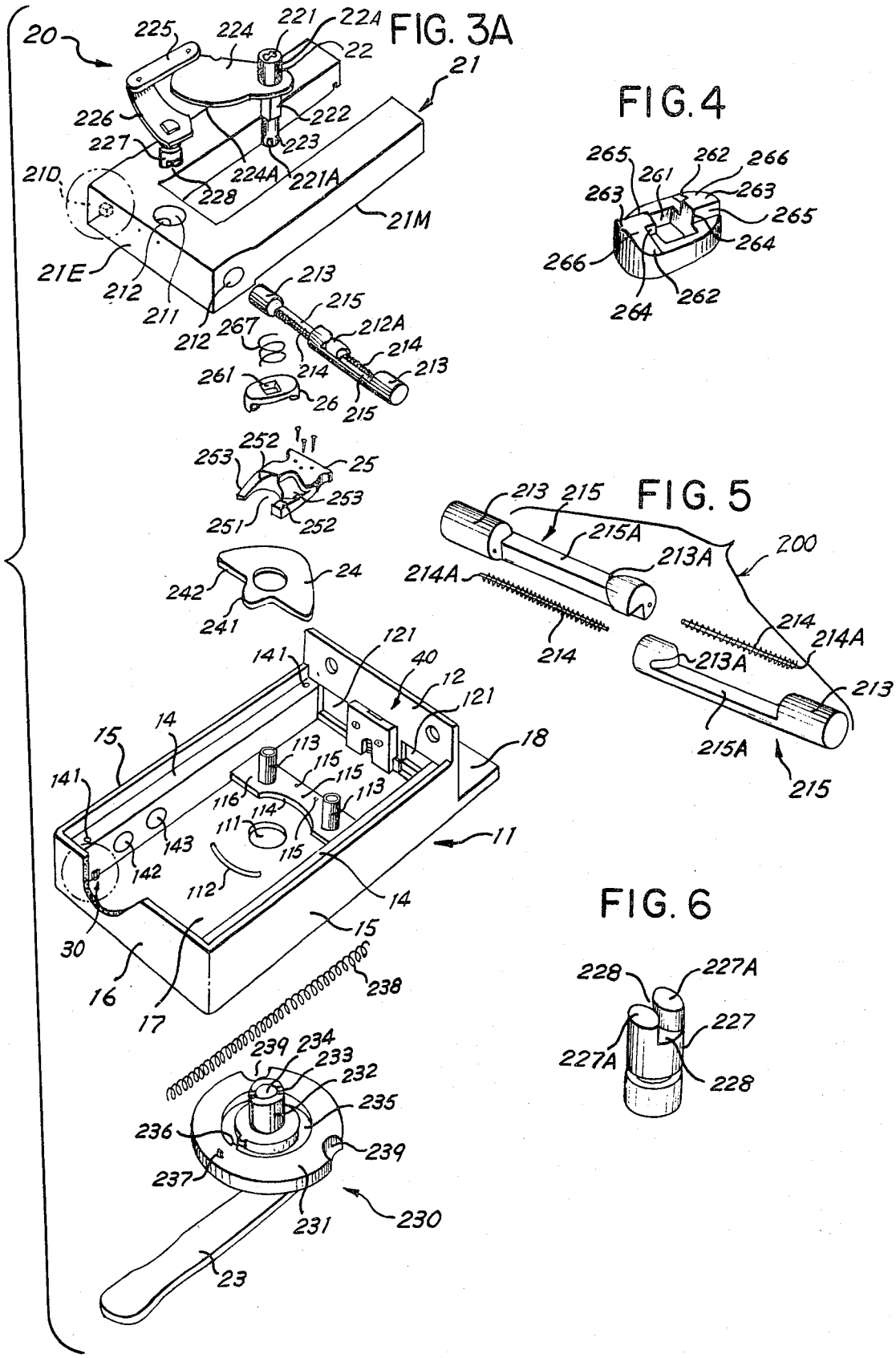
FIG. 4 is an enlarged, oblique, perspective view of the upper cam plate of the door lock of this invention, with the top side turned down.
FIG. 5 is an oblique, exploded view of the interlocking device, enlarged to show the detailed configuration, of the door lock of this invention.
FIG. 6 is an enlarged, oblique, perspective view of the cam shaft of the door lock of this invention, with the top side turned down.

The inter-locking device as shown in FIG. 5 comprises a pair of inter-lock members 215, a pair of compression springs 214 with guides 214A. The inter-lock member 215 is provided at one end with a cylindrical head portion 213 capable of sliding in to and out of the holes 142 and 143, a body portion 215A having a cross section equivalent to a sector of one fourth of the cross section of the head portion 213, and at the opposite end an inverted nose portion 213A having a cut-out of a sector equivalent to one fourth of the cross section of the head portion 213 in such a manner that said cut-out fits the body portion of the opposing inter-lock member when the two inter-lock members are assembled with the inverted nose portions 213A facing peak to peak each other, as shown in FIG. 3. A small blind hole is provided at a suitable position on the inner end surface of the head portion 213 and on the outer end surface of the inverted nose portion 213A. With the two inter-lock members 215 assembled together, one end of the guide rod 214A carrying a spring 214 is inserted into the small blind hole in the head portion of an inter-lock member 215 and the other end of the same guide rod is inserted into the small blind hole in the inverted nose portion of the opposing inter-lock member as shown in FIG. 3. By pressing the inter-lock members assembled as above from the outer ends inwardly, the nose portions 213A are moved apart and thus the lower end portion of the cam shaft 227 can enter there between.

The inter-locking device 200 as described above is slidably inserted in the hole 212 of the cross beam 21E of the lock bolt 21, having the lower end portion of the cam shaft 227, which is inserted from the upper side of the lock bolt 21 into the hole 211, in between the two opposing inverted nose portions 213A, said lock bolt 21 being disposed in the housing 11 with the two bolt members 21M passing by the outer side of the posts 113 and with the two bolt members 21M riding the plate 116 with the front ends of the bolt members extending towards and through the front panel 12. The lower extension 223 of the drive shaft 22 having the spring 263 and the upper cam plate 26 mounted on the square shank thereof is inserted into the hole 234 of the spindle 232 of the operating handle assembly 230 as introduced previously. It is to be noted that the lower cam plate 25 is mounted on to the plate 116 after assembling the operating handle assembly 230 to the housing 11 and before assembling the lock bolt 21 and the actuating mechanism 20 to the housing 11 and the operating handle assembly 230.

A plurality of compression springs 27 are disposed in between the rear end of the lock bolt 21 and rear panel 16 of the housing 11 as shown in FIG. 2. The lock bolt 21 is thus always urged by the springs 27 towards the front of the housing 11.

Figure 9A:
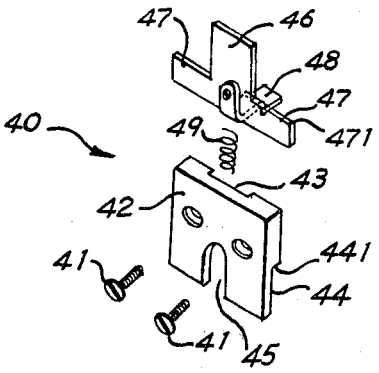
FIG. 9 is an enlarged, oblique, exploded view of the dog device.
FIGS. 9B and 9C are simplified, oblique views of the front portion of the door lock assembly of this invention, showing the operation of the dog device in association with the lock bolt.
Figure 9B:
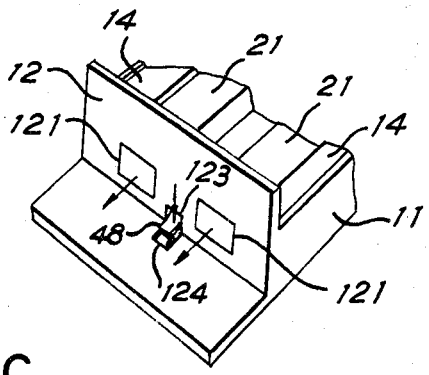
Figure 9C:
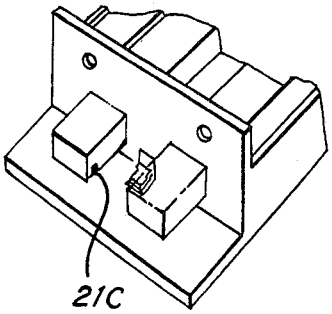

The dog device 40 as shown in FIG. 9A comprises a T-shaped dog piece 471 having a cross bar member 47 adapted to be engaged with and disengaged from the notches 21C formed at the front end portion of the lock bolt 21, a trigger piece 48 secured to the middle portion of said cross bar 47 of the dog piece 471, a spring and a retaining plate 42 having a vertical groove 43 and a horizontal recess 44 in which the T-shaped dog piece 471 is accommodated and an opening 45 through which the trigger piece 48 may be extended. The dog device 40 is assembled and attached to the inner side of the front panel 12 of the housing 11 with cap screws 41, with the trigger piece 48 extending through the hole 123 as introduced previously. The spring 49 is disposed in the recess 124 (FIG. 9B) so that the dog piece riding thereon is urged upwardly all the time. The height of the recess 44 is greater than the height of the cross bar 47 so that the cross bar 47 is capable of vertically moving a certain distance. The ends of the cross bar 47 are adapted to extend beyond the side edges to correspond with the notches 21C on the front end portions of the bolt member 21M. The height of the cross bar 47 is smaller than the distance between the bottom surface of the bolt members 21M and the inner surface of the bottom panel 17 of the housing 11, so that the cross bar 47 can be completely disengaged from the notches 21C allowing the free sliding of the lock bolt 21 when the trigger piece 48 is fully depressed, as shown in FIGS. 9B and 9C.

Figure 10A:
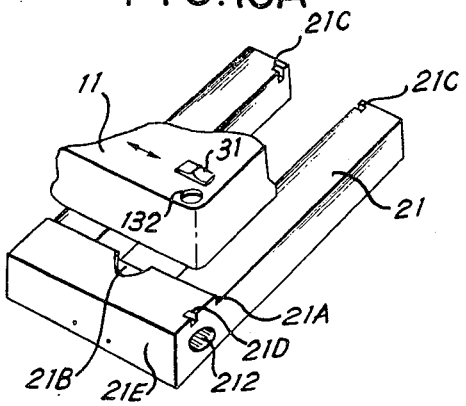
FIG. 10 is a fragmental, oblique view of the lockbolt and a portion of the housing, viewed from the bottom side (or bottom side up), showing the position of the hold-release device in relation with the lock bolt.
FIGS. 10B and 10C are cross-sectional view of the hold-release device, showing "Release" and "Hold" positions respectively.
Figure 10B:
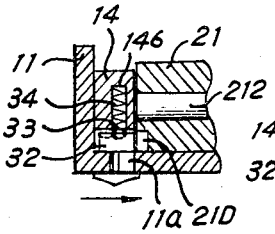
Figure 10C:
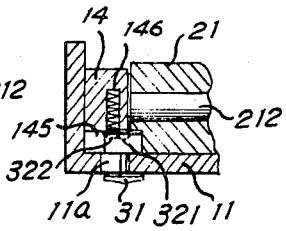
Figure 11:
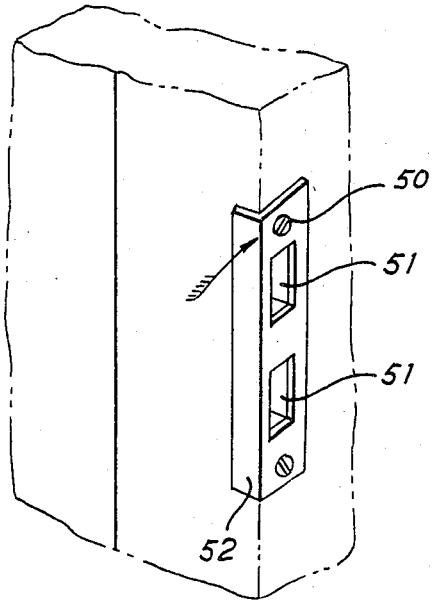
FIG. 11 is an oblique view of the strike installed on the jamb to be used in cooperation with the door lock assembly of this invention.

The hold-release device shown in FIGS. 10A, 10B and 10C comprises a stopper piece 32 adapted to be engaged with and disengaged from the notch 21D formed on the side edge of the cross beam 21E, a knob 31 having an extended portion passing through the hole 132 formed on a corner portion of the bottom panel 17 of the housing 11 and securely connected to said stopper piece, said hole 132 being elongated to allow the movement of the stopper piece 32 with the knob 31 inwardly and outwardly as shown by the arrow in FIG. 10A, said hole 132 being so positioned to permit the engagement of the stopper piece 32 with the notch 21D when the lock bolt is in its rear-most position. The stopper piece 32 is provided with two recesses 321 and 322 (FIG. 10C) to cooperate with a steel ball 33 which is urged by a spring 34 retained in a hole formed in the rear end portion of one of the two side wall members 14, to hold the stopper piece in a release or hold position, respectively. The hold-release device 30 is used to hold the lock bolt 21 in the rear-most position by pushing the knob 31 inwardly to move the stopper piece into engagement with the notch 21D when the lock bolt 21 is in the rear-most position, and to release the lock bolt 21 for free movement by pushing the knob 31 outwardly to disengage the stopper piece 32 from the notch 21D.

The cover plate 13, as shown in FIG. 2, is provided with a center opening 131 through with the upper end 22A of the drive shaft 22 is extended, two holes 132 corresponding with the through holes 113A in the posts 113, two holes 133 corresponding with the mounting holes 144 in the housing 11, and four holes 134 in which the mounting screws 141A are put to mount the cover plate on the housing 11.

The construction, arrangement and function of each component of the door lock of this invention have been described as above. The operation of the door lock with respect to the movement of each component will now be described.

In the following description it is to be understood that the hold-release device 30 is always in release position.

Figure 7A:
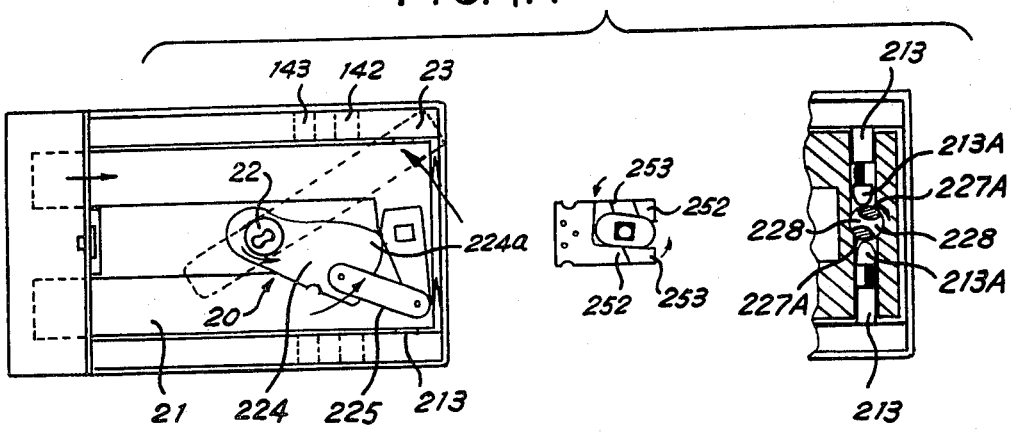
FIGS. 7A through 7F are simplified, sketch drawings showing various operational states of the actuating mechanism and the inter-locking device.

Referring to FIG. 7A, there is shown a state of the door lock of this invention in which the lock bolt 21 is in the rear-most position, i.e., the lock is fully unlocked. In this condition, the drive shaft 22 is at the dead-end of the rotational position in counterclockwise direction and the upper cam plate 26 is in its lowest position, i.e., the key portions 264 are in full engagement with the slot 233 of the spindle 232 of the operating handle assembly 230; in other words, the drive shaft 22 is coupled with the operating handle 23; and the operating handle 23 is in the upper-most position and in the mean time the drive arm 224 and the connecting link are generally in a straight line.

In circumstance as described above the cam shaft 227 is in such angular position that the cams 227A push the interlock members 215 to retract inwardly to the inner most position so that the head portions 213 of the inter-lock members are completely in the hole 212 thus giving no restriction to the movement of the lock bolt 21, but the cross bar 47 of the dog device 40 is in engagement with the notches 21C and the lock bolt 21 is thereby kept from moving by the dog device 40.

Figure 7B:
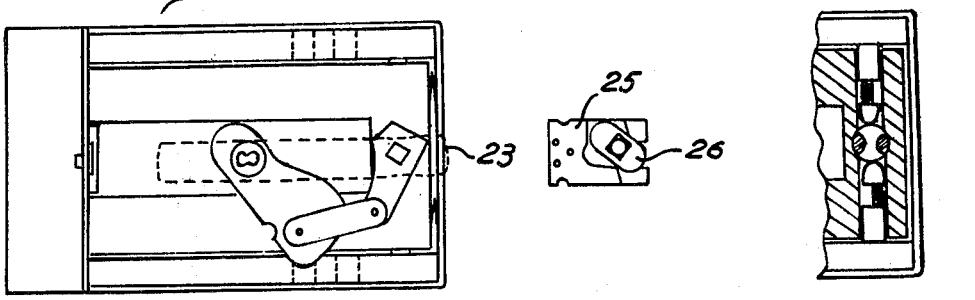
Figure 7C:
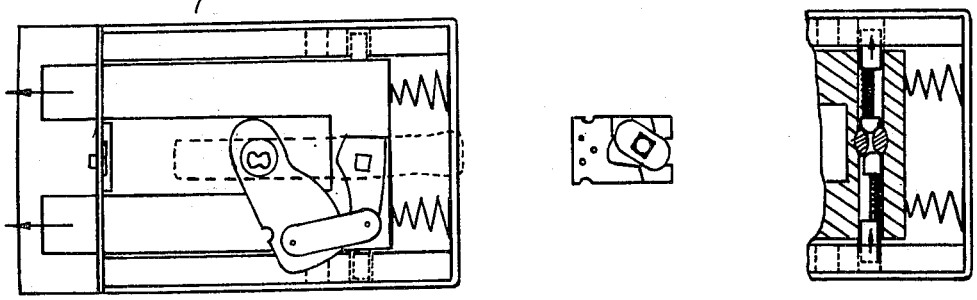

By moving the operating handle 23 down to the horizontal position from the uppermost position as described above, the drive shaft 22 is rotated clockwise and the cam shaft 227 is thus rotated clockwise through the movement of the drive arm 224, the connecting link 225 and the crank 226, to align the cavities 228 along with the axis of the inter-lock members 215, and thereby the inverted nose portions 213A are allowed to move into the cavities 228 but they do not until the lock bolt 21 is moved forward and the inter-lock members 215 are aligned with the holes 142 to permit movement of 215 and 215A, as shown in FIGS. 7B and 7C.

Now close the door while the operating handle 23 is in horizontal position. Upon closing the door the trigger piece 48 will be hit by the edge of the strike on the jamb and thus the cross bar 47 is depressed to be disengaged from the notches 21C to free the lock bolt 21, which is then pushed by the springs 27 to slide forward till the head portions 213 of the inter-lock members 215 are aligned with the holes 142 and pushed by the springs 214 to enter into the holes 142, where the lock bolt 21 is "inter-locked" in the first locking position, as shown in FIG. 7C.

From the foregoing description of the operation of the door lock of this invention with respect to the FIGS. 7A, 7B and 7C it should now be understood that the door lock of this invention automatically locks the door on closing.

The lock bolt 21 can be retracted from the first locking position, or unlocked, by rotating the drive shaft 22 counterclockwise either with a key (that operates the tail piece of the lock cylinder inserted in the hole 221) or with the operating handle 23.

As soon as the drive shaft 22 is rotated counterclockwise to a suitable angle, the drive arm 224 rotates accordingly and pushes the connecting link 225 which in turn pushes the crank 226 to rotate and thus the cam shaft 227 is rotated counterclockwise, for approximately 45 degrees. The rotation of the cam shaft 227 causes the cams 227A to rotate and to push the iner-lock members 215 inwardly or to retract, and thus the lock bolt 21 is relieved from the inter-lock in the first locking position and is allowed to retract when the drive shaft 22 is further rotated counterclockwise with a key or with the operating handle 23. In the process of further rotation of the drive shaft 22 the nose portion 224A of the drive arm 224 comes in contact with the edge of the crank 226 and pushes the crank 226 with the cam shaft 227 to move away from the drive shaft 22 as the drive arm 224 further rotates with the drive shaft 22, to retract the lock bolt 21 against the springs 27.

During the above process the upper cam plate 26 which rotates with the drive shaft 22 remains in the lowest position, i.e., its helically-inclined surfaces 266 are not engaged with the helically-inclined surfaces 252 on the lower cam plate 25, and the key portions 264 remain engaged with the slot 233 of the spindle 232 of the operating handle assembly 230.

Figure 7D:
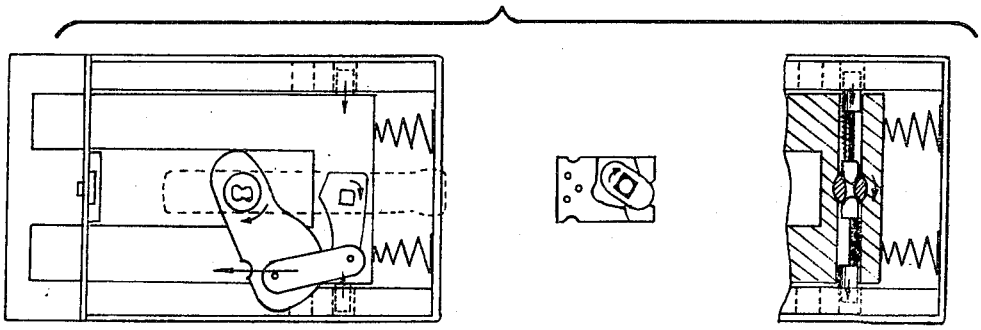
Figure 7E:
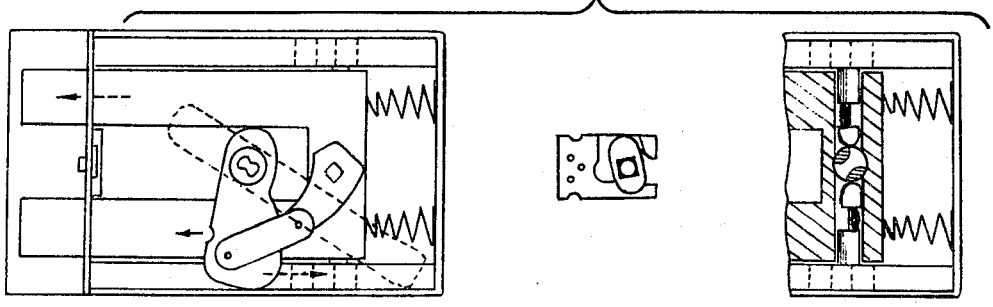
Figure 7F:
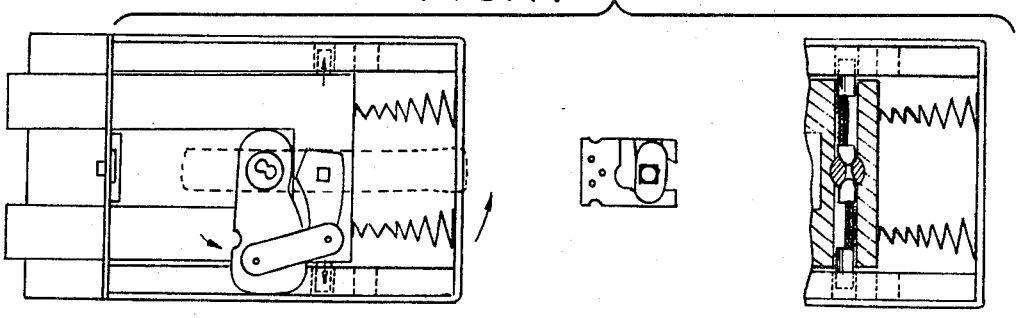
Figure 8:
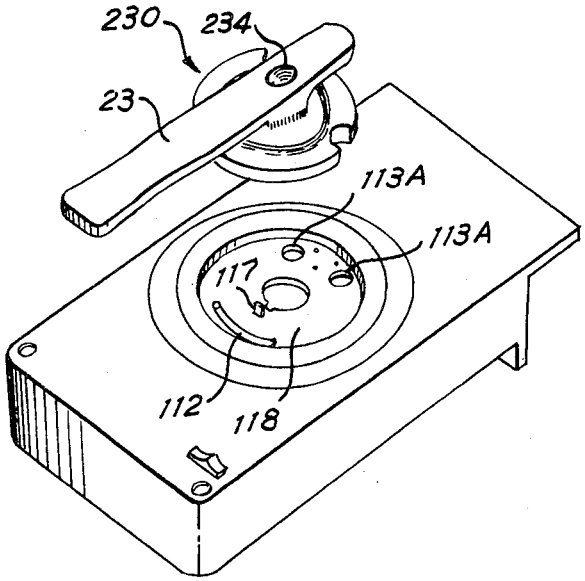
FIG. 8 is an oblique, exploded, perspective view of the housing and the operating handle assembly, viewed from the inside of the door.

The lock bolt 21 of the door lock of this invention can be further moved forward from the first locking position to the second locking position, i.e., to lock the door with higher security. The operation process of moving the lock bolt 21 to the second locking position from the first locking position is performed by clockwise rotation of the drive shaft 22, as shown in FIGS. 7D and 7E. The clockwise rotation of the drive shaft 22, when the lock bolt 21 is in the first locking position, can only be performed with a key that operates the lock cylinder (not shown), or with a key to be inserted in the hole 234 from the inner side of the door to fit the slot 221A at the lower end of the drive shaft 22. This is because the upper cam plate 26 will be lifted to disengage the key portions 264 from the slot 233 of the spindle 232, as soon as the cam plate 26 is rotated clockwise from the previous position, and the drive shaft 22 can no longer be operable with the operating handle 23. This will be explained in the following paragraph.

As soon as the drive shaft 22 is rotated clockwise for approximately 30 degrees from the previous position, the upper cam plate 26 rotates in the same direction causing the helically inclined surfaces 266 (FIG. 4) to engage with the helically inclined surfaces 252 of the lower cam plate 25 (FIG. 3), and as result the upper cam plate 26 is lifted along the axis of the drive shaft 22, therefore the key portions 264 are disengaged from the slot 233 of the spindle 232. In the meantime the cam shaft 227 is also rotated in the same direction, causing the cams 227A to come in contact with the inverted nose portions 213A and to push the inter-lock members 215 to retract inwardly; thereby the "inter-locking" of the lock bolt 21 by the inter-lock member 215 at the first locking position is relieved and the lock bolt 21 is free to move. Further rotation of the drive shaft 22 pulls the cam shaft 227, and, being assisted by the springs 27 from behind, the lock bolt 21 is moved forward. As the lock bolt 21 moves to the front most position while the rotation of the drive shaft 22 reaches to the dead-point (where the drive arm 224 is stopped by the side panel of the housing), the forward movement of the lock bolt 21 causes the cam shaft 227 to rotate backward (counterclockwise) to align the cavities 228 with the axis of the inter-lock members 215 again allowing the outward extending of the head portions 213 of the inter-lock members 215 to enter the holes 143, and thereby the lock bolt 21 is inter-locked at the second locking position.

As described above, in the process that the lock bolt 21 is moved from the first locking position to the second locking position, the operating handle assembly 230 is released from the drive shaft 22 and is free from the movement of the drive shaft 22, the operating handle assembly is pushed back by the spring 238 to its neutral position. In this connection, the washer 24 having a nose portion 241 also returns to the neutral position enabling the engagement with the recess 21B at the front edge of the cross beam 21E of the lock bolt 21 as the lock bolt 21 moves to the front-most position. The engagement of the nose portion 241 of the washer 24 with the recess 21B at the cross beam 21E of the lock bolt 21 forms an "inter-locking" of the operating handle assembly 230, giving an option that the door lock when in the second locking position can not be unlocked with the operating handle 23 but one has to use a key that fits the hole 234 and the slot 221A.

In a special application where one wants the door lock to be unopenable from inside, the outer end of the hole 234 can be plugged with proper means such as screw stud or rivet, or a lock-cylinder can be mounted to the operating handle assembly with its tail piece engaged with the slot 221A.

To unlock the lock or to retract the lock bolt 21 from the second locking position, rotate the drive shaft 22 counterclockwise (with a key), then the cam shaft 227 is first rotated to retract the inter-lock members 215 and second the drive arm 224 is rotated to push the crank 226 with the nose portion 224A, and consequently the lock bolt 21 is moved against the springs 27, till it reaches the rearmost position where it is held by the dog device. In the above process of unlocking from the second locking position, the cam shaft 227 is maintained in such position along with the retracting movement of the lock bolt 21 that the cams 227A hold the inter-lock members 215 in the hole 212 till the lock bolt 21 reaches the rear-most position. Needless to say, the lock bolt 21 can be moved to the first locking position from the second locking position as one may wish, simply by manipulating the key till the click is heard at mid position of the rotation of the key.

By pushing the hold-release knob 31 inward while the lock bolt 21 is in the rear-most position, or fully unlocked, the lock bolt 21 is held at that position and the door lock will not operate even if the trigger piece 48 is hit. This gives an option that the door be kept unlocked as one may wish.

Figure 12:
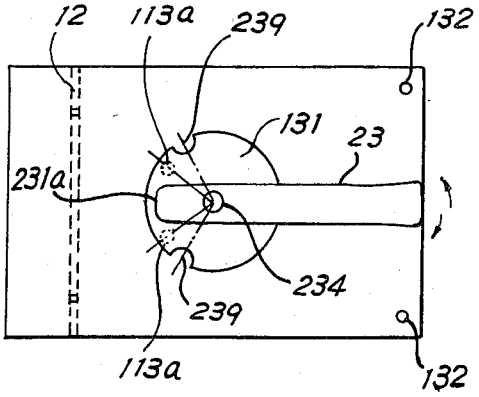
FIG. 12 is a schematic drawing of the door lock assembly with the operating handle in its neutral position, showing the relation between the mounting holes 113A and the cut-outs 239 on the flange 231.

In addition to the mounting holes 122, and 144 the door lock of this invention can be mounted to the mortise of the door with cap screws through the holes 132, and 113A. The mounting cap screws inserted in the holes 132 and 113A will be hidden by the flange portion 231 as it is so designed. The cut-outs 239 are purposely disposed a certain angle off from the axis of the holes 113A as shown in FIG. 12. When mounting the door lock, the flange portion 231 can be rotated to align the cut out 239, one at a time, with the hole 113A to enable the insertion of cap screws, which can be performed while the door is unlocked, but it is not the case when the door is locked with the lock in the second locking position because in the second locking position the operating handle, whose flange portion 231 prevents the access to the mounting cap screws, is inter-locked. This feature provides further security of the lock.

A preferred form of the present invention has been described as above, however, modifications can be made by those skilled in art, for example, the blind holes 142 and 143 can be replaced by rectangular recesses or slots; therefore, the spirit and scope of this invention are defined by the appended claims.

What I claim is:

1. An improved construction of a door lock comprising: a lockbolt formed in U shape operable in association with an actuating mechanism having a drive shaft to be driven by the tail piece of a lock cylinder, an inter-locking device operable in cooperation with said actuating mechanism in relation with the movement of said lock bolt to interlock the lock bolt in locking positions, a plurality of compression springs urging said lock bolt forward, an operating handle capable of selectively engaging with and disengaging from said drive shaft, a housing and a cover plate, a dog device comprising a dog plate formed with a trigger piece, said dog plate being urged by a spring to engage with a notch formed in the front end position of the lock bolt when the lockbolt is fully retracted, said trigger piece being adapted to be hit by the jamb to disengage said dog plate from the notch in the lockbolt when the door is closed, to enable the automatic locking of the door on closing, and second locking position setting means for moving said lockbolt into a second locking position, said second position setting means including disengaging means disengaging said operating handle from said drive shaft so that said bolt cannot be operated by said operating handle, jamming means for preventing operation of said bolt by said operating handle, and key means for rotating said drive shaft for moving said bolt into and out of said second locking position.

2. An improved construction of a door lock according to claim 1, wherein said actuating mechanism comprises a cam shaft connected with said drive shaft by linkage means capable of transmitting the rotational movement of the drive shaft to said cam shaft, said cam shaft being installed in the lockbolt and provided with cam means which is adapted to operate said inter-locking device in association with the movement of the lockbolt.

3. An improved construction of a door lock according to claim 2, wherein said inter-locking device comprises a pair of inter-lock members operable with said cam shaft and a pair of resilient members urging said inter-lock members to perform inter-locking, said interlocking device being accommodated in a hole formed in the lock bolt, with the head portions of said inter-lock members capable of moving in and out of the hole along the axis thereof in association with the rotational operation of said cam shaft to engage with and disengage from a recess or recesses formed in the inside wall of the housing.

4. An improved construction of a door lock according to claim 1, wherein said operating handle is provided with a spindle extending from the outside of the housing through a hole formed in the bottom panel of the housing to protrude inwardly, and is adapted to support one end of said drive shaft, said spindle being provided with a slot across the end thereof and a through hole along the axis thereof,

5. An improved construction of a door lock according to claim 4, wherein said drive shaft is provided coaxillially with an upper cam plate capable of rotating with and sliding along the drive shaft in cooperation with a lower cam plate fixedly mounted on the housing, said upper cam plate having key portions capable of engaging with and disengaging from the slot formed at the end of said spindle of the operating handle, said upper cam plate being urged by a spring from above, so that the upper cam plate is allowed to engage with said spindle of the operating handle when rotated with the drive shaft in one direction and is lifted to disengage from the spindle when rotated in the other direction.

6. The improved construction of a door lock defined in claim 5 wherein said disengaging means includes said upper cam plate which further includes ramp means adjacent to said key portions, said disengaging means further including a lower cam mounted on said housing and including ramp means cooperating with said upper cam ramp means to move said upper cam axially of said drive shaft to move said key portions out of engagement with said operating handle spindle slots.

7. The improved construction of a door lock defined in claim 6 wherein said jamming means includes a washer fixed to said operating handle spindle in the housing and having an abutting portion and an abutment means on said bolt, said washer abutting means contacting said bolt abutment means to prevent rotation of said operating handle, said bolt abutment means contacting said operating handle abutting means when said bolt is in said second locking position.

8. The improved construction of a door lock defined in claim 1 wherein said interlocking device includes a pair of interlocking members, each interlocking member having an elongate body, a head on one end of said elongate body, a noae on another end of said elongate body, a biasing means and means for slidably receiving the body of the other interlocking member so that said interlocking member noses are opposed with said biasing means urging said noses toward each other in a direction tending to lengthen said interlocking device, said interlocking device further including a cam shaft connected to said drive shaft to be operated thereby, said cam shaft including means interposed between said opposed interlocking member noses for forcing said noses apart to shorten said interlocking device, means on said lockbolt for accommodating said interlocking device, and locking means on said housing for receiving said interlocking member heads to interlock said lockbolt to said housing via said interlocking device.

9. An improved construction of a door lock according to claim 8, wherein said housing locking means includes a plurality of recesses in the inside wall in two separate positions, one for interlocking the lockbolt in a first locked position, and the other for interlocking the lockbolt in said second locking position.

10. The improved construction of a door lock defined in claim 1 further including return means for returning said operating handle to a neutral position when said lockbolt is in said second locking position.

11. An improved construction of a door lock, comprising:

a housing and a cover plate;

a U-shaped lockbolt slidably mounted in said housing and capable of moving forward to lock the door and retracting to unlock the door, said lockbolt having a pair of bolt members and a cross beam connecting said pair of bolt members, each bolt member having a free end having a notch defined therein;

an actuating mechanism having a drive shaft operable by a tail piece of a lock cylinder, a drive arm connected to said drive shaft, a connecting link connected to said drive arm and a crank connected to said connecting link, a cam shaft operatively connected to said drive shaft by said crank connecting link and drive arm, said cam shaft being rotatably inserted in said lockbolt cross beam for moving said lockbolt when said drive shaft is rotated;

an interlocking device operable by said cam shaft to interlock the lockbolt to said housing in a locking position;

an operating handle mounted on said housing;

means for selectively engaging said operating handle with and disengaging said operating handle from said drive shaft;

urging means for resiliently urging said lockbolt toward one end of said housing; and a dog device mounted on said housing and having a spring and a trigger piece resiliently urged by said spring to engage with said lockbolt notch to latch said lockbolt when said lockbolt is retracted to unlock the door, said trigger piece being positioned to be hit by a jamb of the door to be disengaged from said lockbolt notch when the door is being closed.

12. An improved construction of a door lock as defined in claim 11, wherein said crank and said connecting link are adapted to transmit the rotational movement of said drive shaft to said cam shaft and also to cause said lockbolt to move forward and to retract when said drive shaft is rotated, and said interlocking device comprises a pair of recesses defined in said housing, a pair of interlock members operably connected to said cam shaft, and a pair of resilient members mounted on said interlocking device to urge said interlock members away from each other to thereby extend said interlocking device, said cross beam having a hole defined therein, said interlock members being accommodated in said cross beam hole and capable of extending by force of said resilient members to engage with said housing recesses to interlock said lockbolt to said housing in a locking position when said cam shaft is rotated to one position, and to retract by the rotational movement of said cam shaft to disengage from said recesses to release said lockbolt from being interlocked to said housing when said cam shaft is rotated to another position.

13. An improved construction of a door lock as defined in claim 12, wherein said housing is provided with a plurality of recesses in an inside wall thereof in two separate positions to be selectively engaged with said interlock member, one set of recesses for interlocking the lockbolt in a half-way locked position, and another set of recesses for interlocking the lockbolt in a fully locked position.

14. An improved construction of a door lock as defined in claim 11, wherein said operating handle is provided with a spindle extending from the outside of the housing through a hole formed in a bottom panel of said housing to protrude inwardly of said housing, said spindle being adapted to support one end of said drive shaft, said spindle having a slot defined therein to extend across the spindle end, said spindle having a longitudinal through hole defined therein.

15. An improved construction of a door lock as defined in claim 14, wherein said operating handle is provided with a washer securely fixed to said spindle inside the housing, said cross beam having a recess defined therein, said washer having a nose portion positioned to engage said cross beam recess when the lockbolt is fully extended to lock the door to prevent said spindle from rotating.

16. An improved construction of a door lock as defined in claim 15, further including a lower cam plate fixed to said housing, and wherein said drive shaft has an upper cam plate slidably mounted thereon for rotation therewith, said upper cam plate contacting said lower cam plate to cause said upper cam plate to slide along said drive shaft, said spindle having an end slot formed therein, said upper cam plate having key portions capable of engaging with and disengaging from said spindle end slot, said upper cam plate having a spring urging said upper cam plate into engagement with said spindle when rotated with the drive shaft in one direction, said lower cam plate having lifting means thereon to lift said upper cam plate to disengage said key portions from said spindle end slot to disengage said upper cam plate from said spindle when said handle is rotated in an opposite direction.

* * * * *